United States Patent [19]

Blades et al.

[11] B 3,986,871

[45] Oct. 19, 1976

[54] CHARGED PARTICLE MODULATOR DEVICE AND IMPROVED IMAGING METHODS FOR USE THEREOF

[75] Inventors: John D. Blades, Chagrin Falls; Jerome E. Jackson, Shaker Heights, both of Ohio

[73] Assignee: Addressograph-Multigraph Corporation, Cleveland, Ohio

[22] Filed: Dec. 12, 1973

[21] Appl. No.: 423,883

[44] Published under the second Trial Voluntary Protest Program on January 27, 1976 as document No. B 423,883.

[52] U.S. Cl. ..... 96/1 R; 96/1.5

[51] Int. Cl.[2] ..... G03G 13/044

[58] Field of Search ..... 96/1 R, 1.3, 1.5

[56] References Cited

UNITED STATES PATENTS

| | | | |
|---|---|---|---|
| 3,615,395 | 10/1971 | Yamaji et al. | 96/1 R |
| 3,625,604 | 12/1971 | Pressman | 96/1 R |
| 3,645,614 | 2/1972 | McFarlane et al. | 96/1 R |
| 3,666,365 | 5/1972 | Tanaka et al. | 96/1 R |
| 3,680,954 | 8/1972 | Frank | 96/1 R |
| 3,694,200 | 9/1972 | Pressman | 96/1 R |

*Primary Examiner*—David Klein
*Assistant Examiner*—Judson R. Hightower
*Attorney, Agent, or Firm*—S. L. Goldstein; M. A. Kondzella

[57] ABSTRACT

The invention is an improved modulator, in the form of a screen, having the capability of selectively passing therethrough charged particles, such as gas ions, in accordance with a pattern that corresponds to the image and non-image areas of a graphic original. The apertured modulator is formed from a metal screen, such as a 200 mesh wire screen, having a wire cross section of 0.051 millimeter and is overcoated with a four-micron thickness of a photoconductor, such as selenium or an organic photoconductor, over which is next applied an equal thickness of an insulating layer, such as polystyrene. The three-layered modulator constructed in this manner is imparted a charge pattern corresponding to the graphic subject to be reproduced by the creation of a charge distribution system (CDS) on the insulating surface. The CDS created on the modulator in the environment of this invention is completely passive to electromagnetic radiation. The modulator is placed between an emission electrode and collection electrode to selectively pass therethrough gas ions to be received onto a dielectric surface in a charge pattern corresponding to the graphic subject from which the charge distribution system was created on the insulating layer.

The technique and procedure whereby such a developable charge image is created on a dielectric material, such as a sheet of paper, involves disposing the modulator, bearing its charge distribution system, in the environment of an arrangement of electrodes which includes a corona emission electrode juxtaposed with the metal side of the modulator for creating gas ions in air which are directed into the apertures of the modulator and a collection electrode disposed on the side opposite facing and immediately juxtaposed with the insulating surface for directing the ions toward a sheet of dielectric paper in contact with the collecting electrode.

30 Claims, 11 Drawing Figures

CHARGED PARTICLE MODULATOR DEVICE AND IMPROVED IMAGING METHODS FOR USE THEREOF

BACKGROUND OF THE INVENTION

The present invention relates generally to the field of electrophotographic imaging techniques, and more specifically, is directed to the use of a foraminated device which is capable of having stored thereon a charge pattern corresponding to the light and dark areas of a graphic original and which device can then be used to selectively transmit and otherwise block the passage of charged particles directed towards its surface. The ions which are permitted to pass through the modulator are then collected on a dielectric material and developed into a visible image. For the purpose of the description of this invention which follows, the term "charged particles" will be deemed to define not only toner particles but also gas ions which are deemed to be charged particles. The term blocked, when used herein, will describe the condition of the charged particle not passing through the particular aperture in the modulator due to being attracted to the modulator or otherwise repelled from the aperture into the stream of particles to be projected into another aperture.

Electrophotographic reproduction techniques for making reproductions of graphic originals using photoconductive media are well known. Such processes call for applying a blanket electrostatic charge to a photoconductive layer, and then exposing it to a pattern of light and shadow created by directing electromagnetic radiation onto such graphic original and then projecting the resulting pattern by means of an optical system onto the light-sensitive photoconductive layer. In the light-struck areas of the layer, the charges are conducted to ground, leaving behind a charge pattern corresponding to the dark or shadow areas of the graphic original. The images are rendered visible by the application of an electroscopic powder which is then fixed directly onto the photoconductive layer, or can be transferred and then fixed on a suitable receiving medium such as plain paper.

This technique of electrophotographic reproduction has been extended in this art to foraminated structures which are formed by applying a photoconductive layer to a wire screen mesh or similar apertured structure. The response of the photoconductive medium in such an apertured structure is the same as is experienced in conventional electrophotographic imaging techniques in that the photoconductive layer can be charged, thereby rendering it sensitive to electromagnetic radiation, and thereafter exposed to a pattern of light and shadow to create an electrostatic charge pattern thereon. Such foraminated structures are known in this art as photoconductive screens, modulators and apertured photoconductive materials. In describing the structures of this invention, the term "modulators" will be used to define the apertured devices capable of accepting an electrostatic charge and responding to a pattern of light and shadow to have recorded thereon an electrostatic charge distribution system which can be utilized in ordinary room light without affecting the continued existence of any charge pattern on the surface thereof.

The photoconductive screens which have been developed heretofore and are known in the prior art fall into three distinct classes:

The first is a two-layered screen construction which is formed by applying a photoconductive layer onto a metallic screen. Such a structure is capable of accepting an electrostatic charge corresponding to a pattern of light and shadow created by electromagnetic radiation directed onto a graphic original. The operation and construction of such a device requires that the projection of ions through the screen occur simultaneously with the projection of the pattern of light and shadow. The simultaneity requirement is occasioned by the inability of such a system to retain or have any "memory" in terms of the charge pattern imparted to the structure.

A second group of photoconductive screens has been adapted for use with charged material particles but not gas ions. Such structures suffer from the deficiency that charged particles accumulate in those areas of the structure which attract the particles. Ultimately, it is required that the screen be cleaned to physically remove the particles in order that the screen may be reused.

The third group of screen-type structures known in the prior art are essentially two-layered structures containing a nominal third insulating layer which is included for the purpose of providing a proper surface resistivity in the circumstance that the photoconductor does not have the proper range of resistivity and thereby improving the charge-carrying capacity of the photoconductive layer. Such screens have been described as having the capability of projecting gas ions through certain areas of the screen while preventing their passage through other areas which attract such ions in accordance with the charge pattern imparted to the photoconductive layer. The time duration of the ion discriminating capabilities of such a photoconductive screen structure is a function of the dark decay properties of the photoconductor. Of necessity, therefore, any electrostatic fields which have been created in the apertures of the photoconductive screen by virtue of the charges accepted by the photoconductive layer are in a continual state of decay.

To more fully appreciate and understand the modulator structures of this invention, it is necessary to discuss the known processes for imaging a photoconductive member which has been overcoated with an insulating layer. These processes employ continuous photoconductive members formed by applying a suitable photoconductor to a conductive layer and then applying a third layer which is a highly insulating, transparent material, over the photoconductor. The application of a blanket electrostatic charge to the insulating layer results in the injection of oppositely poled charges into the conductive layer in the direction of the insulating layer. The injection of such oppositely poled charges, which ultimately are bound at the interface between the photoconductive layer and the insulating layer, occurs by virtue of the rectifying properties of the photoconductive layer. This dipole charge state could also be achieved by applying a blanketing charge simultaneous with flood illumination using a non-rectifying photoconductor. The insulating layer thus has a uniform field applied across its thickness, and any previous charge distribution system (CDS) has been satisfactorily erased for the receiving of a new CDS.

Upon simultaneous exposure to a corona electrode connected to an AC supply source and a projected pattern of light and shadow, the charges on the insulating layer are erased by the corona. The charges which are bound at the interface are leaked to ground by rendering the photoconductive layer conductive in the light-struck areas.

In the dark areas the effect of the AC corona is to connect the top of the insulating layer to the conductive layer, causing some of the charges to be transferred to the metal base and causing oppositely poled charges to be bound at the interface between the photoconductive layer and the metallic layer. In the dark areas, the outer insulating layer and the conductive layer are at an equal potential level. The net charge across all three layers is zero and the ability to control charged particles directed to the modulator does not occur until the member is flood illuminated.

As a final step, the photoconductive member is given a flood exposure of electromagnetic radiation which now causes the photoconductive layer, overall, including the formerly dark portions, to become conductive, causing these charges to leak off to ground, leaving those charges that are bound at the interface between the photoconductive layer and the insulating layer by the remaining charges on the surface of the insulating layer. Hence, a dipole charge system is created across the insulating layer in those areas corresponding to the shadow or dark portions of the graphic original.

In another system for creating a charge pattern on such a three-layered structure, there is applied a blanket electrostatic charge under conditions in which the photoconductive layer does not possess special rectifying properties and hence a charge is produced across the insulating layer and a corresponding, oppositely poled charge between the photoconductive surface and the metal layer. Again, any previous CDS is also erased for the receiving of a new, fresh CDS.

In the next step of the process, the photoconductive layer is exposed to a pattern of light and shadow so that the light-struck areas will cause the migration of charges to the interface between the insulator and the photoconductor. In the dark or shadow areas, the arrangement of the charges remains the same. As the third step, a charge from an AC corona is applied to the photoconductive medium in the dark areas which reduces the charge in the insulating layer in the non-exposed dark portions, but in the light-struck areas, where the charges have migrated to the interface, a fraction of the original charge remains.

As the final step of the process, the photoconductive member is given a blanket illumination which reduces the voltage in the photoconductor, causing the charges to be conducted to ground and produces a net charge of a polarity opposite to that of the DC corona in the light-struck areas of the member.

It is important to note that in the first process described, the developable image occurs in the areas that have not been light exposed, whereas in the second process, it is the light-struck areas that represent the developable image or CDS.

The aforedescribed photoconductive members of the prior art are known to have the capability of retaining the charge pattern that has been created on its insulating surface for extremely long periods of time and the persistence of said charge pattern to be unaffected by electromagnetic radiation, particularly radiation in the optical spectrum.

SUMMARY OF THE INVENTION

It has been found that a three-layered foraminated member can be constructed using a wire mesh conductive screen to prepare a photoconductive member capable of selectively transmitting ions through the apertures or attracting the ions thereto and retaining this capability for very long periods of time. In fabricating such a structure conventional photoconductive materials known in this art are applied to a screen and a highly insulating transparent layer is then applied over the photoconductor. The resulting structure must retain the general foraminated configuration of the screen in order to provide an apertured structure and thereby to provide the improved modulators of this invention.

Such modulator construction permits the creation of a charge distribution system (CDS) on the insulating layer by first applying a blanket electrostatic charge of one polarity to the surface of the insulating layer and then applying a charge from an AC corona emission electrode and simultaneously projecting thereon a pattern of light and shadow. Alternatively, the charged surface may be exposed to a pattern of light and shadow and sequentially applied the AC charge from a corona electrode. This results in zero potential in the light-struck areas of the modulator and distributes the charges in the dark areas so that they are at an equal potential level, or when using the alternative procedure, the dark the are at zero potential and distribute the charges in the light-struck areas. The modulator is given a final flood illumination step, causing charges in the photoconductive layer, which correspond to the dark areas of the graphic original, to be conducted to ground leaving a residual charge on the surface of the insulating layer and a corresponding charge bound at the interface between the insulating layer and the photoconductive layer. Such CDS results in electric fields corresponding to the pattern of light and shadow generated by illuminating the graphic original which are confined to the apertures in the modulator. These fields do not extend, to any appreciable extent, outside the thickness of the modulator. The electrical fields are the result of the dipole charge created across the insulating layer. The result is that in the vicinity of an aperture a charged particle or an ion which encounters such a field may be either blocked or accelerated or propelled through the aperture depending upon the strength and direction of the field.

It is characteristic of gas ions that are produced in air by a suitable high-voltage corona wire or a radioactive source to experience motion which is governed by the electric fields in the vicinity of the ion and by the number of collisions with the air molecules attributable to random thermal motion. The forces involved in both of these situations are electric in nature. The motion of such gas ions can be controlled by the external fields produced by external electrodes juxtaposed the modulator. The use of such electrodes in combination with the modulator is of significant importance in the practice of this invention.

The electrical fields which are produced by such additional electrodes are set up so as to direct a uniform stream of ions through the modulator onto a collecting medium or collecting surface where such charges can then be developed by suitable developing means. The electrical fields must be of sufficient strength to overcome the random thermal motion of such ions in the vicinity of the aperture and must also be in a direction perpendicular to the ion collecting surface.

To achieve the aforedescribed control with respect to the gas ions, the modulator is placed close to and in a plane parallel to the plane of the ion collecting medium. Such a collecting medium is under the influence of a collecting electrode.

Hence, there is provided an ion projection assembly in which a modulator is positioned between an emission electrode establishing a field between the modulator and the electrode which directs gas ions toward the base layer side of the modulator and a collection electrode, which is positioned on the opposite side of the modulator (juxtaposed the insulating surface) which similarly produces a field whose direction is perpendicular to the collecting surface. Associated with the collecting electrode is a collecting medium such as a sheet or web of dielectric material in intimate contact with the collecting electrode on which is received the gas ions which are projected or transmitted through the modulator.

The two significant characteristics of the modulator field, that is, the property of blocking the ions and the propelling effect are determined by the polarity of the charges emitted by the imaging electrode, the polarity and voltage applied to the collection electrode, and the nature of the pattern of light and shadow projected onto the photoconductor side of the screen.

It is a general object of this invention to provide an improved imaging process involving the use of an ion modulator which is capable of retaining a charge distribution system for extended periods of time, which is capable of selectively controlling the transmission therethrough of ions to be directed to a collecting medium and which may be reused to project the same charge pattern onto different collecting media.

It is another object of this invention to provide an improved imaging system using an ion modulator in the environment of an electrode system which provides a high degree of flexibility as to the type of image which may be reproduced from either a positive or negative type graphic original.

It is a specific object of this invention to provide an improved imaging system in which an ion modulator is used in conjunction with an ion projection electrode system capable of projecting ions at a sufficiently high rate to be deposited on a collecting medium to produce high density images in rapid succession.

It is a further specific object of this invention to provide an improved imaging system using a modulator in the environment of an ion projection system which exhibits a high degree of ion discrimination corresponding to the image and non-image areas of a graphic original so as to produce reproductions having a high contrast on an ion collecting medium.

It is a further object of this invention to provide an improved multiple layer ion modulator which is capable of having a charge distribution stored on its surface for extended periods of time, and which may be utilized in ordinary room light so that the discriminating properties as to impinging gas ions thereon is independent of the dark decay characteristics of the photoconductive layer.

It is a further specific object of this invention to provide a multiple layer modulator made up of a photoconductive layer sandwiched between a conductive layer and an insulating layer, and is capable of having stored on the surface of the insulating layer a charge distribution system corresponding to the image and non-image areas of a graphic original for extended periods of time.

It is a still further specific object of this invention to provide a reproduction apparatus capable of making high-quality multiple reproductions of a graphic original utilizing a modulator in conjunction with an ion projection system, whereby a charge distribution is created on the modulator corresponding to the image and non-image areas of the graphic original and which is capable of repeatedly reproducing said graphic original on ion collection media rapidly to produce high contrast copies and with a fidelity such that a wide range of half-tone originals are accurately reproduced.

It is a still further specific object of this invention to provide an improved duplicator in which images are rapidly and successively reproduced on ion receiving media without the necessity of having to transfer any material from one surface to another surface.

It is yet a further specific object of this invention to provide an improved multiple layer modulator comprised of a photoconductive layer sandwiched between a conductive layer and an insulating layer, having the capability of a high level of charge acceptance achieved by controlling the geometrical shape of the layers with respect to one another.

Other objects and features of this invention, particularly the numerous applications to which such a unique system may be applied in the reproduction field of art will become apparent to those skilled in this art from a reading of the following detailed description.

Figure 6:
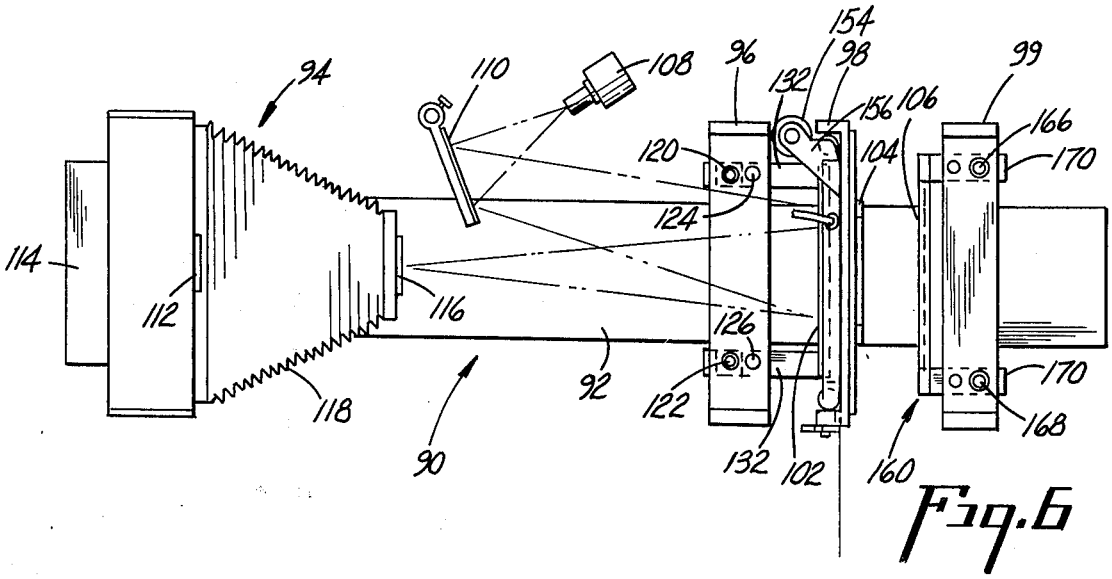
FIG. 6 is a plan view of an apparatus capable of carrying out the objects of this invention.
Figure 7:
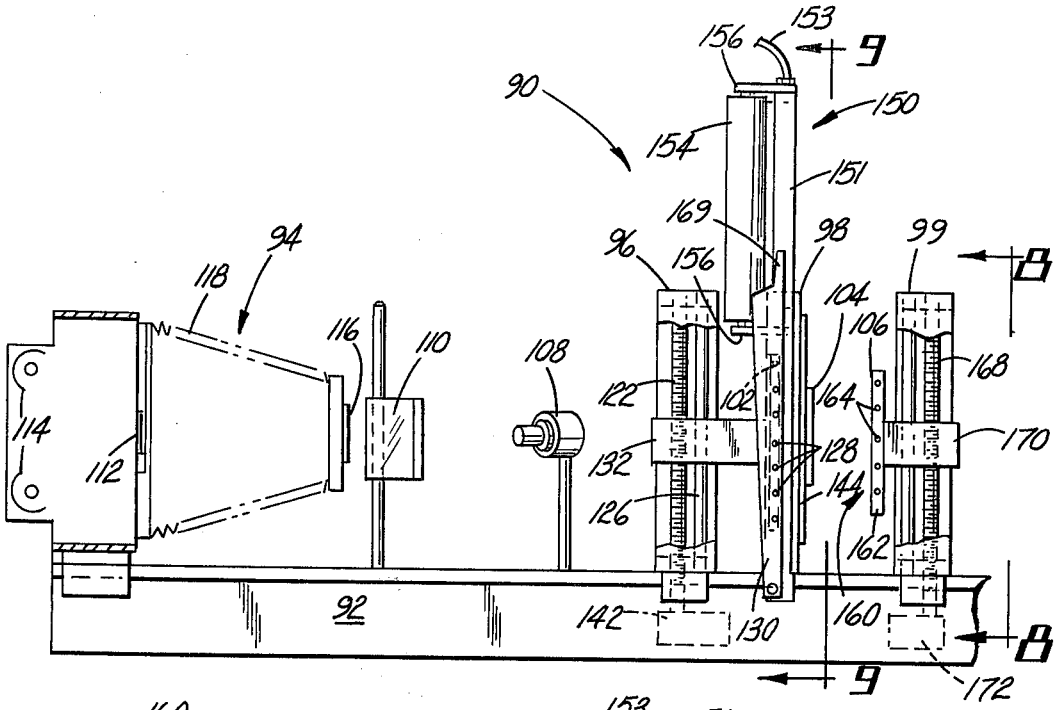
FIG. 7 is an elevation view of the apparatus in FIG. 6.
Figure 8:
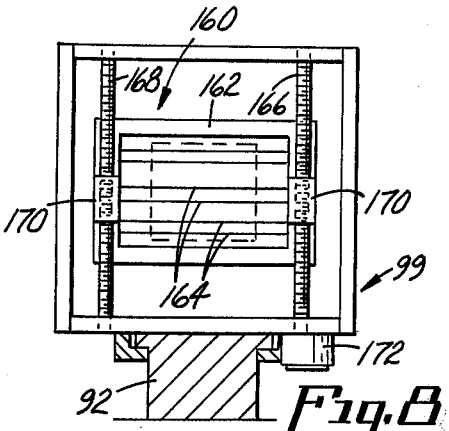
Figure 9:
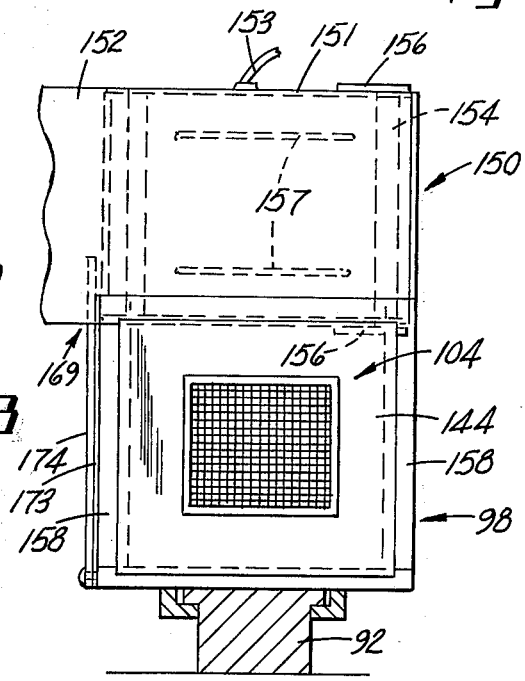
Figure 10:
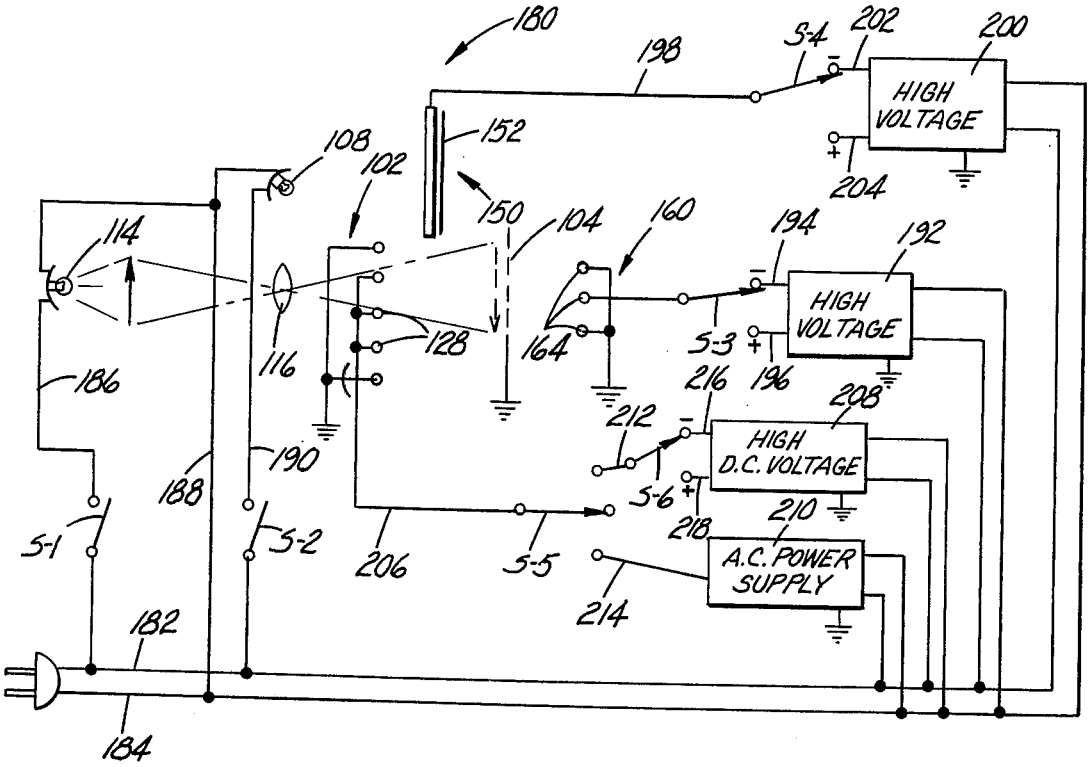

FIG.. 7A is an enlarged top plan view of the corona charging electrode;

FIG. 8 is an enlarged detail taken along line 8-8 of FIG. 7 showing one of the electrode constructions of the apparatus; and FIG. 9 is an enlarged detail taken along 9-9 of FIG. 7 showing the electrode assemblies of the apparatus; and FIG. 10 is a schematic diagram of the electrical circuit showing the various switching controls and power supplies for the instrumentalities comprising the apparatus of FIG. 6.

DETAILED DESCRIPTION OF THE INVENTION

Figure 1:
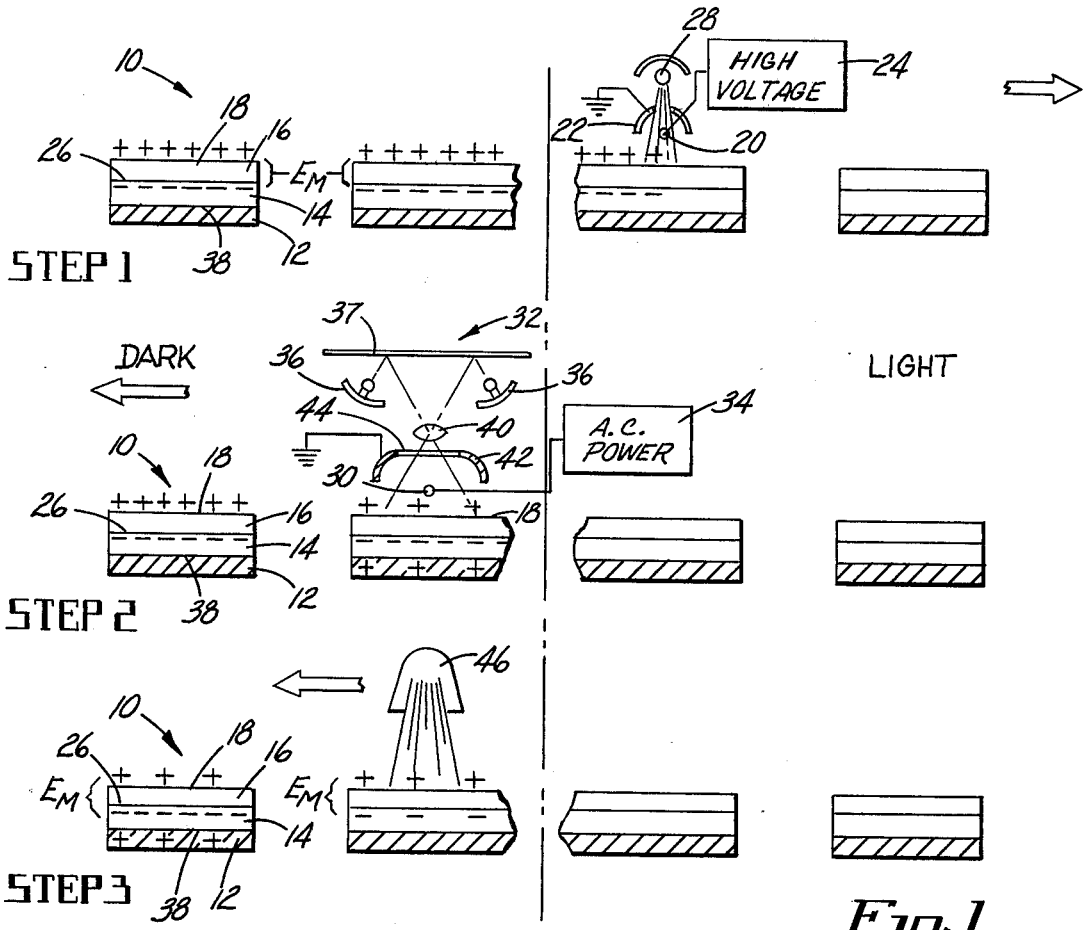
FIG. 1 is a schematic representation showing the three processing steps for creating the charge distribution system on the modulator.

Referring now to FIG. 1, there are illustrated the various steps for preparing the foraminated modulator of the instant invention whereby there is created thereon the CDS which results in the zones for attracting the ions and the zones which would be capable of transmitting or otherwise propelling ions therethrough. The establiment of such zones enables the modulator to determine which ions are to be transmitted therethrough and ultimately collected on a suitable collection medium for development into a visible image which is representative of the graphic original to be reproduced.

In Step 1 there is shown in cross section the modulator of this invention identified generally with the numeral 10, being comprised of three separate and distinct layers, the first being the conductive layer 12 which is formed of a wire mesh screen wherein the conductive material may be stainless steel, copper, brass, aluminum or steel wire. The use of metals readily satisfies the requirements for conductivity required in this base layer; however, other conductive or semi-conductive materials may also be used as long as the resistivity is less than $10^9$ ohm centimeters.

Superimposed on the conductive layer 12 is the photoconductive layer 14 which may be any one of the conventional photoconductive materials such as the usual and well known elemental conductors of which selenium is most representative; inorganic photoconductive metal ion-containing crystalline compounds, such as zinc oxide, and cadmium sulfide; and a wide range of organic photoconductive materials both polymeric and non-polymeric. The non-polymeric organic photoconductors include the benzofluorenes and dibenzofluorenes, described in U.S. Pat. No. 3,615,412 to William J. Hessel, and the cumulenes, described in U.S. Pat. No. 3,674,473 to Robert C. Blanchette, both assigned to the same assignee as this invention. These patents are incorporated by reference herein.

Examples of polymeric organic photoconductors are the polystyrenes, polyvinylxylenes polyvinylnaphthalene, poly-2-vinylnaphthalene, poly-4-vinylbiphenyl, poly-9-vinylanthracene, poly-3-vinylpyrene, poly-2-vinylquinoline and polyacenapthalene. Suitable polymeric organic photoconductors also include the polyvinylcarbazoles including the polyvinylarocarbazoles, for example the polyvinylbenzocarbazoles described in U.S. Pat. No. 3,751,246 to Helen C. Printy and Evan S. Baltazzi and the polyvinyliodobenzocarbazoles described in U.S. Pat. No. 3,764,316 to Earl E. Dailey, Jerry M. Baron, Ralph L. Minnis and Evan S. Baltazzi, both assigned to the same assignee as this invention. These patents are also incorporated by reference herein.

The organic photoconductors are generally utilized in conjunction with a suitable sensitizer to extend the spectral range of the photoconductor. Dyes may be used for this purpose. Another class of materials which are widely used are $\pi$-acids. Representative of these compounds are the oxazolone and butenolide derivatives of fluorenone, described in U.S. Pat. No. 3,556,785 to Evan S. Baltazzi, the dicyanomethylene substituted fluorenes, described in U.S. Pat. No. 3,752,668 to Evan S. Baltazzi and the bianthrones described in U.S. Pat. No. 3,615,411 to William J. Hessel, all assigned to the same assignee as this invention. These patents are also incorporated by reference herein.

One advantage of using an organic photoconductor as the photoconductive layer in the modulator of this invention is the ease of fabrication of the modulator, which can be conveniently provided in any desired form or shape. The conductive layer can be coated with the organic photoconductor by applying a solution or dispersion of the organic photoconductor. Polymeric organic photoconductors are conveniently applied by use of a suitable solvent for the polymer. Organic photoconductors which are not polymers can be applied by dispersing in a resin binder. In some cases it is possible to spray a solution or dispersion of organic photoconductor upon the base conductive layer in order to provide the desired photoconductive coating.

In addition to the ease of fabrication in using an organic photoconductor, photoconductive layers comprised of organic photoconductors are flexible, strongly adherent to the base conductive layer of the modulator and capable of being readily coated by an insulating material. In some instances the photoconductive layer can, as a result of the use of an organic photoconductor, be made transparent or translucent as desired.

The thickness of the photoconductive layer 14 is not critical. However, as a general guideline, the thickness of layer 14 should be in the range of from 1 to 20 microns and preferably in the range of from 3 to 10 microns. It should be applied with a sufficient degree of consistency and uniformity so as to provide a uniformly contoured layer over the conductive layer 12.

The third and final layer of the modulator 10 is the insulating layer 16. This layer is required to have a resistivity in the range of $10^{13}$ to $10^{18}$ ohms centimeter. Suitable insulating materials which may be used in the formation of the layer 16 are polystyrene, polyester resins, polypropylene resins, polycarbonate resins, acrylic resins, vinyl resins, epoxy resins, polyethylene terephthalate and polyfluoride resins. The resins may be applied from a solvent solution by spraying the screen structure or otherwise dipping the structure into a solution in order to provide a uniform thickness of the insulating material onto the photoconductive layer. The third layer must be firmly bonded and is required to make complete contact with the photoconductive surface in order to operate effectively. The general procedures for fabricating such modulator structures will be described in greater detail hereinafter.

In Step 1 of FIG. 1 the surface 18 of the insulating layer of the modulator 10 is applied a blanket electrostatic charge from a source of ions such as may be provided from a corona electrode 20. As shown in Step 1 of FIG. 1, the electrode 20 is adapted to traverse the entire surface area 18 of the insulator 16 moving in the direction of the arrow so as to apply a blanket electrostatic charge to the layer. Simultaneous with the spraying of charges, the surface is uniformly illuminated with electromagnetic radiation in the visible portion of the spectrum from the lamp 28. The electrode construction itself is conventional and is shown to be enclosed in a shield 22 which is connected to ground. The corona electrode 20 is connected to a direct current high-voltage source 24. The radiation source 28 is part of the electrode being included in the shield 22. The distance between the surface 18 and the electrode 20 is in the range of 1 to 4 centimeters, the preferred range being from about 1 to 1.5 centimeters.

The charges which are sprayed from the electrode 20 are positively poled, but it will be appreciated that the polarity of this charge will depend on the nature of the particular photoconductor that is employed, that is, whether it has charge acceptance characteristics favoring the use of a positive or negative charge. In addition, as will be explained in further detail hereinafter, the polarity of the initial charge which is applied to the modulator will determine which portions of the CDS that will operate either to transmit and project charged particles through the modulator or be blocked at the aperture.

The spraying of the charges results in the application of a blanket positive charge to the surface 18 of the insulating layer 16. The position of the charges on the surface of the insulating layer causes the injection of oppositely poled charges through the conductive layer 12 through the interface 38, through the photoconductive layer 14 which are bound at the interface 26 between the photoconductive layer 14 and the insulating layer 16, so that there now results a dipole charge across the layer 16. The dipole charge is such that equal and opposite charges are bound and retained at the interface 26 of the modulator.

It is important to recognize that in this step there has been created a field $E_m$ across the layer 16. The positive charges from the electrode 20 cause the injection of charges through the conductive layer 12 which is a function of the rectifying properties of the photoconductive layer 14. In other words, the specific properties of the photoconductive layer permit the charge injection through the conductive layer so that there is a charge separation as a result of the spraying of charges of one polarity to the surface of the insulating layer. To assure that the photoconductive layer 14 is of the proper resistivity, that is, properly conductive, there is provided an illuminating source 28 which moves simultaneously with the corona electrode and renders the layer conductive. In this manner the image charge in the layer 12 due to the charge in the layer 16 can be transferred to the interface 26.

As depicted in Step 2 of FIG. 1, the modulator is simultaneously subjected to an AC corona discharge from the electrode 30 which is connected to an AC power supply 34, and a pattern of light and shadow corresponding to the light and dark areas on a graphic original from a projection assembly identified generally as 32.

The projection assembly 32 is comprised of a pair of radiation sources 36 which provide a source of incandescent radiation to a graphic original 37, which is then projected through a lens 40 onto the surface 18. In order to provide access of the projected image onto the surface, the electrode 30 is equipped with a conductive shield 42 which is connected to ground and which is equipped with an opening therein 44 which extends longitudinally along the shield so as to permit the projection onto the transparent insulating surface 18 of the pattern of light and shadow generated by directing electromagnetic radiation onto a graphic original. The path of the optical system is then coincident with that of the AC corona electrode 30.

It will be appreciated that the pattern of light and shadow may be produced also using a transparent negative and directing radiation through the transparency.

The function of the electrode 30 is to erase the positive charges on the insulating layer 16 in those areas that are struck by light. This is accomplished by the AC corona which has the effect of connecting the insulating layer 16 to the conductive layer 12 so that the positive charges leak off as shown in Step 2. With the simultaneous application of light and shadow, the areas in the photoconductive layer 14 that are exposed to such radiation become conductive, and negative charges trapped at the interface between the photoconductive layer and the insulating layer flow from said interface in the light-struck areas to ground.

To more clearly illustrate the effect of such simultaneous treatment, the modulator 10 is depicted in Step 2 as having areas which are light exposed and areas which are protected from exposure to radiation, which areas correspond to the dark or shadow portions of the original subject matter to be reproduced. In actual practice, of course, the occurrence of such areas over the surface will be a function of the original or graphic subject matter from which the pattern of light and shadow is created.

In the light-exposed areas of the modulator 10, there are no charges remaining in the various layers, and, therefore, the modulator in these areas is at zero potential. In the dark or shadow areas of the modulator which correspond to the dark areas of the original, there are disposed charges on the surface 18 of the insulating layer 16 and the original charge which is bound at the interface 26, as well as the interface 38 between the photoconductive layer 14 and the conductive layer 12. Hence, the potential of the surface 18 and interface 38 are the same in the dark areas. Insulating layer 16 causes the member to have a residual internal charge in the dark areas at the interface 26, which, therefore, holds a corresponding charge at the surfaces 18 and 38 so that the sum of the charges at 18 and 38 equal the charges at 26.

In the final and third step, the modulator 10 is given a flood exposure from a source of electromagnetic radiation 46. As is shown, the radiation source 46 is adapted to traverse the surface of the modulator flooding it with illumination. This causes the photoconductive layer 14 to become conductive in those portions not previously exposed. Some of the charges trapped at the interface 26 are thus caused to leak off to the conductor 12, cancelling the image charge in this layer. This results in removing the field from within the photoconductive layer 14 without affecting the field within the insulator layer 16.

In the dark areas of the exposure pattern there remains a charge at the interface 26 which is equal and opposite to the charge remaining on the insulating surface 18. Hence, there is a potential on the surface 18 that produces an electrical field $E_m$ across the insulating layer 16.

The foregoing description sets forth one of the processes whereby the modulator is imparted a CDS which corresponds to the generated pattern of light and shadow. In other words, there has been created a charge pattern corresponding to the light and shadow areas representative of the graphic original 37. The nature of this CDS is such that there is an electrical field in the dark zones of the modulator and no charge pattern or field in the light-struck areas.

Figure 2:
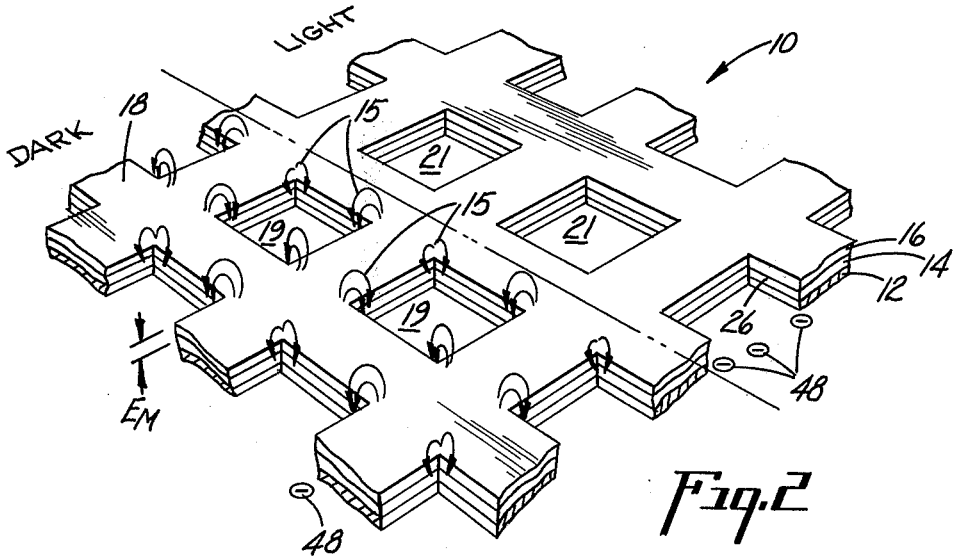
FIG. 2 is a schematic representation in perspective of one form of ion modulator having created thereon the charge distribution system and showing the direction of the fields created within the apertures.

Referring now to FIG. 2, there is shown the modulator 10 which has a CDS, and, hence, a field $E_m$ across the thickness of the insulating layer 16, which extends into the aperture 19. The field $E_m$ emanating from the insulating layer 16 at each of the openings 19 will have a very specific effect on any charged particle entering the aperture. In the practice of this invention, it is preferable to project the charged particles in the direction of the conductive layer 12 so that they cannot readily collect on the insulating layer 16 and thereby interfere with the field $E_m$. In the circumstance that the ions emitted from an emission electrode are directed toward the surface 18 of the modulator 10 with the CDS thereon, it will result in the accumulation of further charges wihch tend to obliterate the existing CDS so that the modulator thereafter is incapable of operating to selectively project ions therethrough or to attract other ions in accordance with the CDS.

It is the establishment of the field $E_m$ across the layer 16 which makes it possible for the modulator 10 to either block ions as they enter the aperture 19 in the dark areas or to permit them to pass through. The presence of the field $E_m$ that results from a positively poled precharge causes the field lines 15 to emanate from the insulating layer 16 and be directed towards the modulator at the interface 26. The direction of the field lines 15 are shown in a conventional manner as moving from positive to negative charge. The field lines 15 extend into the aperture 19 and it will therefore be appreciated that the effect of the field $E_m$ on an ion which enters the aperture will be a function of several variables, the strength of the field expressed in terms of newtons per coulomb, or volts per centimeter, which in turn, is directly related to the charge concentration on the insulator 16; the direction of the field and the contour of the field which in turn is related to the geometrical disposition and relationship of the three layers. The effect of these variables on the ion entering the apeture will be discussed in greater detail hereinafter.

Continuing the discussion with respect to FIG. 2, there is shown a negatively poled ion 48 entering the aperture 19 and encountering the field $E_m$ which is countercurrent to the direction of the movement of the ion. The negatively charged particle 48 moves counterdirectional to the field lines 15 and therefore will not be blocked but will be propelled through. In the circumstances that the charged particle, 48, would be a positive ion instead of a negative one, the direction of the field being countercurrent to the direction of the ion, would cause it to be blocked at the aperture 19.

If the field $E_m$ in the aperture were created utilizing a negative precharge, then the direction of the lines of force would be reversed and the field lines would emanate from the interface 26 and be directed to the surface 18. In the environment of such a field, a negative ion entering the aperture 19 would be caused to be blocked, whereas the positive ions will pass through, since they would be co-current to the direction of the field. As discussed earlier in this description, the term "blocked" defines the result of the operating forces at the modulator preventing the ion from going through the aperture. The ion may be attracted to metal layer or it may be repelled and rejoin the mainstream of ions and move toward another aperture. Hence, from the foregoing description, it will be understood that in the dark areas of the modulator, the field $E_m$ operates to control the movement of the ions entering the aperture, causing them either to be blocked at the aperture 19, or to pass through the aperture, depending on the polarities of the dipole charges and the ions entering the aperture.

Thus far in this discussion there has been described the operations of the modulator with respect to the dark zones which correspond to the dark portions of the pattern of light and shadow. The light-struck areas of the modulator, as shown in FIG. 2, are free of any field and, hence, the control of the movement of the ions in the areas of the modulator which are exposed to radiation is different than what occurs in the dark areas. Since the modulator is placed in the environment of an ion projection system which includes a corona emission electrode, it will be apparent that a field is established between such an emission electrode and the conductive layer 12 of the modulator 10. This causes a field oppositely poled to the polarity of the emission electrode to be induced in the conductive layer 12 and will cause the attraction of the ions emitted from the electrode to the conductive layer in the light-struck areas. As shown in FIG. 2, the gas ions 48 which come within the vicinity of the aperture 21 due to their random motion, will, for the most part, be attracted to the conductive layer 12. However, a minor proportion of such gas ions will pass through the aperture.

To summarize the nature of the invention as described up to this point, it is possible to selectively control the movement of ions through the modulator by selecting the appropriate polarities of the initial charge applied to the insulating surface and the projected charged particles or ions. The modulator can be made to either block ions in the apertures in the dark or light zones of the modulator.

Figure 3:
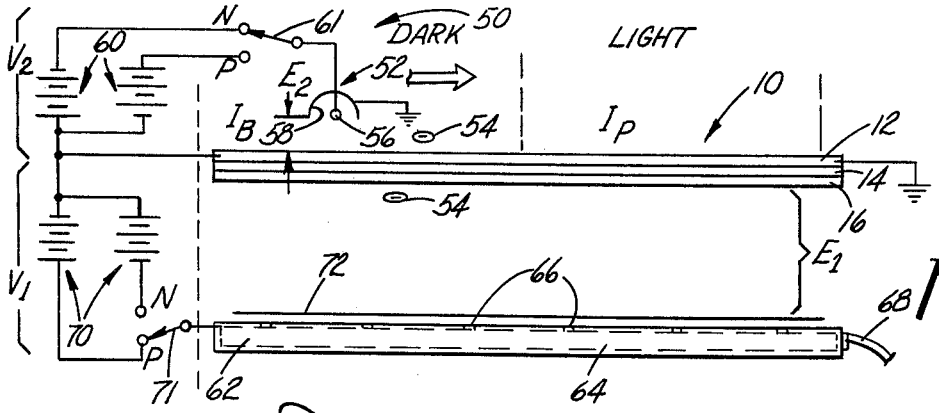
FIG. 3 is a schematic representation showing the projection assembly wherein the modulator of this invention is employed to selectively discriminate ions emitted from a source to create a reproduction on a suitable collecting medium.

In order to use the modulator as an imaging device by virtue of its capability of discriminating ions entering its apertures, it is necessary to place it subsequent to forming the CDS in an environment that is likened to a grid system in a triode vacuum tube. Referring now to FIG. 3, there is shown an ion projection assembly 50 comprised of an emission electrode 52 which projects ions toward the conductive layer 12 of the modulator 10. The electrode 52 comprises a corona wire 56 surrounded by a conductive shield 58 which is connected to ground. The wire 56 is connected to the negative terminal of a potential source 60 by operating the switch 61 to the contact N; the positive terminal being connected to the conductive layer 12. The emission electrode 52 creates a field $E_2$ between the corona wire 56 and the surface of the conductive layer 12, in which lines of force emanate from the conductive layer 12 and are directed towards the corona wire 56.

Certain of the impinging ions 54 which are directed to the modulator, will pass through and come under the influence of the collecting field $E_1$ produced by the collecting electrode 62. The collecting electrode consists of a hollow plate member 64 which is equipped with openings 66, in one surface thereof, to permit the influx of air into the interior of the plate and having an outlet 68 which leads to a vacuum pump for exhausting air from the hollow plate so as to cause a pressure differential between the atmosphere and the surface thereof. The electrode 62 is connected to the positive terminal P of a potential source 70 through the operation of the switch 71 to the connection terminal P. The electrode is disposed in the projection assembly 50 so that it lies in a plane parallel to the plane of the modulator 10 facing the insulating layer 16 thereof.

The receiving medium 72, which may be a sheet or web of suitable material, such as dielectric paper, plastic film, or cloth, is placed on the surface of the plate 64 in contact with the openings 66. The removal of air by the pump system through the outlet 68 causes a pressure differential at the surface of the plate causing the medium 72 to be brought into intimate contact with the electrode 62.

As the ions 54 pass through the modulator 10, they come under the influence of the collecting field $E_1$ which causes them to be propelled and directed to the collecting electrode 62 and to be attracted to the surface of the medium 72 in a pattern which conforms to the CDS of the modulator 10 which is representative of the pattern on the graphic original to be reproduced. Upon completion of the collection of the ions on the receiving medium 72, the medium is removed from the electrode assembly and a visible image is developed by conventional developing techniques.

Referring further to the projection assembly 50 of FIG. 3, the modulator 10 is imparted a positive blanket electrostatic charge by operating the switch 61 to contact P so that the surface of the modulator has a field direction emanating from the corona wire in the direction of the conductive layer 12. The conductive layer 12 of the modulator is connected to the negative terminal of the potential source 60. Ions 54, now positive, will be directed toward the modulator from the corona wire. The potential applied to the emission electrode 52 is in the range of 8,000 volts. The range for the field strength $E_2$ is 400 – 800 volts/centimeter.

The plate 64 of the collecting electrode 62 now is connected to the negative terminal N of the potential source 70 through the operation of the switch 71 and the positive side of the potential source 70 is connected to the conductive layer 12. The output of the potential source 70 is in the range of 5,000 volts, causing the ions that come under the influence of $E_1$ to be propelled in the direction of the receiving medium 72. The range for the field strength $E_1$ can be from 500 to 12,000 volts/-centimeter.

The field $E_1$ emanates from the conductive layer 12 through the photoconductive layer 14 and insulating layer 16 in the direction of the surface of the collecting electrode 62.

The projection assembly as described in FIG. 3, wherein the modulator is imparted a positively charged CDS and is subjected to negative ions 54 will result in the passage of these ions through the dark portions of the modulator and the blocking of ions in the light-struck areas of the modulator, with some ions also being transmitted in the apertures 21, to produce a reproduction whose image areas correspond to the dark or image portions of the graphic original 37 in FIG. 1.

To more fully illustrate the utilization of the modulators of the instant invention in the environment of a projection assembly, the following examples are presented which will give the details of the fabrication and the various modes of operation of the modulator to create reproductions of a graphic original.

EXAMPLE 1

POSITIVE REPRODUCTION FROM A NEGATIVE GRAPHIC ORIGINAL

Figure 4:
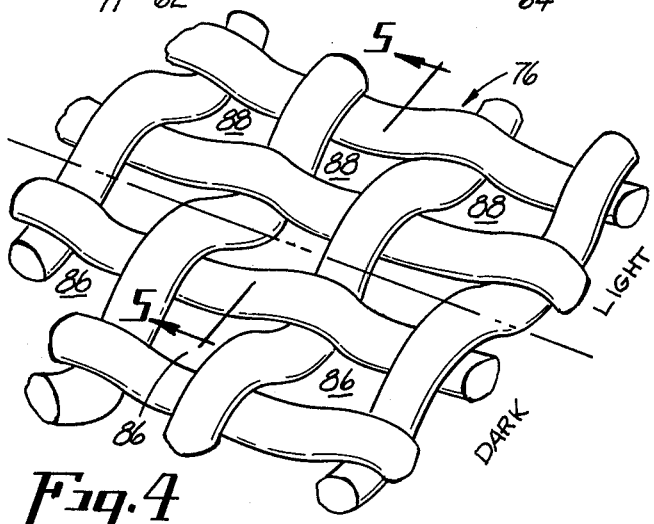
FIG. 4 is a schematic representation in perspective of another form of an ion modulator which utilizes a woven metallic screen as the base layer.

In preparing the modulator of this example, a wire mesh screen, having a 200 mesh size, is used as the base support. The screen is formed of a woven stainless steel wire such as shown in FIG. 4. The wire diameter is 0.05 millimeter and the 200 mesh screen designation defines a structure whose average apertures are 0.074 millimeter in the widest dimension.

The metal screen is thoroughly cleaned before it has a photoconductive layer applied to its surface. As set forth in the general description hereinabove, a wide range of photoconductive materials may be used. In this example, a uniform coating of amorphous selenium is applied by a conventional vacuum deposition technique in which the selenium is thermally evaporated in a vacuum system from a molybdenum or tantalum boat onto the screen. The average thickness of the evaporated selenium layer is about 10 microns.

The third layer to be formed is the insulating layer which is a polymeric material such as polystyrene. A solution is made up of polystyrene consisting of 5% by weight of solids available from Dow Chemical Corporation, sold under their product designation as PS-1 or PS-3. The solvent system includes 4 parts of butyl acetate, 4 parts methyl cellosolve acetate, and 2 parts methyl ethyl ketone. The resulting solution is sprayed onto the screen in sufficient quantities to provide an insulating layer, when dry, of about 4 microns in thickness. In the circumstance that the polymeric materials are thermoplastic, such as polystyrene, they are heated to a condition of plasticity to get a smooth uniform surface.

In examining a photomicrograph of a cross section of the multilayered structure, it was observed that the selenium layer is applied to the top surface of the screen, leaving the metal undersurface, as well as the lateral edges of the metal wire, fully exposed. The spray application of the polystyrene solution covers not only the photoconductive layer, but also applies a thin layer to the bottom surface of the wire mesh. Such an application of the insulating layer covers the metallic surface, but in no way does it impair the function of the modulator to block the ions, nor does it in any way disturb the electrical fields extending between the emission electrode and the surface of the metal layer.

Figure 5:
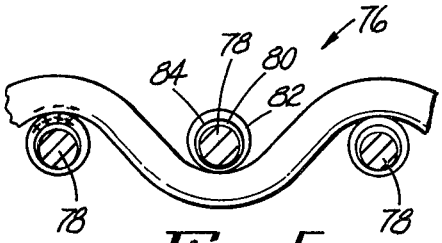
FIG. 5 is an enlarged detail taken along the line 5-5 of FIG. 4 showing in cross section the geometric configuration of the various layers.

Referring to FIG. 5, there is shown the form of the stainless steel woven mesh screen 76 which has all of the layers applied to its surface as described in this example. The stainless steel wire strand 78 is shown to have applied a first layer 80 which is the photoconductive material. The layer 80 tends to partially envelope the wire strand 78 leaving uncoated the bottom portion of the wire.

After the spraying operation, the modulator is dried by placing it in a heated air stream maintained at room temperature for a period of three hours in order to facilitate evaporation of the solvent and permit the coating to fully and completely dry. To the finished modulator is then imparted a charge distribution on the insulating layer following the description in FIG. 1, with the exception that in this example, a blanket negative electrostatic charge was imparted to the modulator so that its surface had a field direction emanating from the interface 84 between the photoconductive layer 80 and the insulating layer 82 and being directed to the surface of the insulating layer 82.

The geometry of the various layers, as represented in FIG. 5, provides a distinct advantage in the operation of the modulator. It has been observed that the complete envelopment of the wire, in the manner described herein, permits applying a greater concentration of charge during the imaging step as described in connection with Step 1 of FIG. 1. In a typical situation, as the charge concentration builds up, it tends to be laterally distributed over the surface of the insulating layer. Upon continued application of ions from the charging electrode, they tend to be distributed along the lateral edges of the wire, ultimately reaching the conductive wire 78, and thence conducted to ground.

In the circumstance that the structure is enveloped in the insulating layer, it is possible to obtain a substantially higher concentration of charges through the use of such a layered configuration because continued application of charge merely accumulates on the insulating surface without encountering or making contact with any conductive portions of the screen. This permits applying anywhere from 30 to 100% greater charge as compared to a screen construction in which the wire is exposed.

The modulator 76 is then placed in the environment of an ion projection assembly similar to what was described in connection with FIG. 3. The metal layer of the modulator is connected to the positive terminal of the potential source 60 and the corona wire 56 is connected to the negative terminal so that negative ions are directed toward the modulator from the emission electrode 52. The potential $V_2$ applied to the emission electrode was in the range of 8,000 volts.

The plate 64 is connected to the positive terminal of the potential source 70 which applies potential to the collecting electrode, and the negative terminal of the potential source is connected to the conductive layer 12.

The direction of the field $E_2$ (FIG. 3) emanates from the surface of the conductive layer 12 and is directed to the corona wire. The field $E_1$ emanates from the plate 64 of the collecting electrode and is directed to the insulating surface 16. The voltage $V_1$ supplied to the collecting electrode was 5,000 volts. As the negative ions are projected from the corona wire 56, they move into the general vicinity of the conductive layer 12, which is at a lower potential, and the ions will generally come within each of the apertures 86 in the dark zones and the apertures 88 in the light zones. A large number of the negative ions will enter the apertures 88 by virtue of random ionic motion. In the light zones there is absent the field $E_m$ and therefore they will be moved out from the aperture and come under the influence of the field $E_1$. Not all of the ions entering apertures 88 will be transmitted through since some ions will be attracted to the conductor 12 since the insulating coating applied to the conductive base is very thin.

The transmission of the negative ions through the modulator in the light-struck zones is then directed by the field $E_1$ toward the plate 64 to be intercepted on the dielectric collecting medium.

In the dark areas, there is a field $E_m$ created across the insulating layer by virtue of having established thereon the CDS so that the direction of the field $E_m$, as explained, is from the interface 84 between photoconductive layer 80 and the insulating layer 82. The negative ions are attracted to the modulator since movement of the ion into the aperture 86 and the field $E_m$ are codirectional, thereby blocking the passage of the ions through the modulator.

It should be pointed out that in this example, the blocking of ions is accomplished in the dark zones in a very complete manner.

In the circumstance that the graphic original 37 (FIG. 1) to be reproduced is a positive original, that is, it has dark images on a light background, the procedures set forth in this example would result in a reverse reading reproduction, namely the light area of the original would be visibly reproduced on the imaging medium which is ultimately developed into a visible image. In order to obtain a positive reading reproduction, it is only necessary to develop such a charge pattern with reversal developing powder which would then produce a positive image from a positive original.

Another approach to obtaining a positive reproduction would require that the graphic original 37 be a transparent negative, that is, the image portions transmit radiation so that the techniques used in this example would transmit ions in the light-struck areas and hence give a positive from a negative.

It is important in this example to give consideration to the adjustment of the voltage that is applied to the emission electrode and the collecting electrode, respectively, so that the field $E_2$ extending between the emission electrode and the conductive surface is maintained at a smaller value and weaker by comparison to the field $E_1$, which provides the propelling effect as the particles come under the influence of $E_1$. This can also be accomplished by adjusting the values of $V_1$ and $V_2$ and the relative distances between the modulator and the collection electrode and emission electrode in the projection assembly. The presence of a strong field between the collecting electrode and the modulator will tend to contour the field lines so that they penetrate the apertures 88 increasing the probability of propelling the ions through the apertures and onto the collecting medium.

The time duration for the ion projection imaging step in this example was approximately one second and resulted in producing an image on the collecting medium having a density of 2.0 density units. Because of the complete collection of ions at the apertures 86 (FIG. 4), the corresponding areas on the image reproduction did not attract any of the developer material. Hence, the reproduction was of extremely high contrast.

EXAMPLE 2

POSITIVE REPRODUCTION FROM A POSITIVE GRAPHIC ORIGINAL

The imaging techniques described in this example utilize a modulator fabricated in the same manner and following the same procedures as set forth in Example 1.

To the finished modulator was then imparted a CDS using positive corona in conjunction with a source of radiation so as to render the photoconductive layer suitably conductive so that charges would be injected from the conductive layer to the interface between the insulating layer and the photoconductive layer. The potential in the charged areas of the insulating layer attributable to the initial charge was about 160 volts and the field across the insulating layer was in the direction emanating from the top surface of the insulating layer and being directed to the interface.

The modulator was then disposed in an ion projection system in which the emission electrode was connected to a potential source supplying about 8,000 volts of a negative polarity, thereby causing the emission of negative ions towards the conductive surface of the modulator. The plate of the collecting electrode was connected to the positive terminal of a potential source supplying 5,000 volts.

As the negatively charged ions come within the aperture in the light-struck zones of the modulator, they are blocked. However, it should be pointed out that a small amount of negative ions do pass through the screen to ultimately be collected on the imaging medium.

In the dark areas of the modulator, that is, those which are not exposed to radiation and correspond to the dark areas of the graphic original, the ions are accelerated through due to the field $E_m$. The character of the field $E_m$ is determined by the positive character of the CDS which is counter to the direction of the ions.

Hence, they are propelled through the aperture coming under the influence of the field $E_1$.

The field $E_1$ then propels the negative ions in the direction of the collecting electrode to be collected on the surface of the imaging medium 72 producing thereon negatively poled charge pattern corresponding to the dark areas of the original.

From the description in this example it will be appreciated that it is possible to optimize the final contrast of the reproduction through the adjustment and selection of the applied voltages $V_1$ on the collection electrode and $V_2$ on the emission electrode. Each applied voltage and corresponding geometrical arrangement between the electrodes and the screen governs the strength of the electric fields which enhance the control of the modulator field $E_m$. The field $E_2$ on the conductor side of the screen, which results from the corona emission electrode and charge transport should be minimized relative to the strength of $E_m$ in order to permit the modulator to exert its control and reduce the number of ions transmitted through the modulator in the light-struck zones.

Control of the field $E_2$ adjacent the modulator may also be accomplished through the use of a conductive grid in conjunction with the corona electrode and maintaining the grid at a given potential. Such a construction is generally referred to as a scorotron. The use of a scorotron is particularly advantageous where it is necessary to greatly control the strength of the field but still maintain the necessary voltage to the wire to create the corona.

The selection of the voltage $V_1$ can also be optimized to supplement the fields near the apertures to enhance the $E_m$ fields.

Other examples offer this unique advantage of affecting the degree of selectivity of transmission through the apertures on the incoming ions. This is made possible by changing the geometry or shape of the insulating coating applied to the photoconductive layer.

Development of the resulting charge pattern on the imaging medium 72 produces a reproduction having a density of 1.5– 1.7 density units in the dark areas but also produces some slight background.

EXAMPLE 3

The imaging procedure of this example follows the details and description set forth in Example 1 with the exception that the modulator was prepared using cadmium sulfide as an inorganic photoconductive material dispersed in an insulating resin binder. The thickness of the cadmium sulfide-resin binder layer was about 5 microns and an overcoated insulator had a thickness of 2.0 microns.

To the modulator was applied an initial positive electrostatic charge producing a positive oriented CDS on the surface of the insulating layer.

The imaging process was carried out under conditions wherein the emission electrode was connected to the positive terminal of the potential source thereby directing positively charged particles to the modulator. The collecting electrode was connected to the negative terminal of the potential source.

Under these conditions the positive ions were blocked in the dark zone of the modulator and were transmitted in the lightexposed zones. Using a transparent negative this resulted in the production of a positive reproduction from a negative original on the imaging medium 72 when developed with positively oriented electroscopic powders.

The imaging process whereby a sufficient concentration of positive ions were collected on the imaging medium 72 required about one second exposure to the emission electrode. The image density which resulted measured 1.5 units using a conventional densitometer.

EXAMPLE 4

The imaging tehniques of this example followed the procedures set forth in Example 1 with the exception that the photoconductive layer was zinc oxide dispersed in a resin binder in place of amorphous selenium.

To the modulator was imparted a negatively poled blanket electrostatic charge which produced a negatively oriented CDS.

The utilization of the modulator for imaging a sheet of dielectric paper was accomplished using the ion projetion assembly as described hereinabove wherein the emission eletrode was connected to the negative terminal of the potential soure and the collecting electrode to the positive terminal.

In the dark zones of the modulator, the negatively charged ions were blocked by the apertures in the dark zones whereas in the light-struck zones the negative ions were permitted to pass through.

The ion projection process required about 1.3 seconds, and the density of the resulting copy was about 1.5 with a measurable background density of 0.02 density units.

EXAMPLE 5

The imaging procedure of this example follows the details and description set forth in Example 1 with the exception that the modulator was prepared using an organic photoconductor as follows: 10 grams of 2, 3-benzofluorene was dispersed in 90 grams of a styrene-butadiene copolymer sold by Goodyear Tire & Rubber Company under the trademark "PLIOLITE S-50" whih was dissolved in 360 grams of toluene. A quantity of 0.84 gram of 2,4,7-trinitrofluorenone malonodinitrile, a $\pi$-acid was added to the dispersion and the resulting composition was sprayed onto the screen. The average thickness of the organic photoconductive layer was about 10 microns after drying in a heated forced air drying oven to evaporate excess solvent.

The time duration for the ion projetion imaging step in this example was approximately one second and resulted in produing an image on the collecting medium having a density of 2.0 density units.

EXAMPLE 6

The imaging tehniques described in this example utilize a modulator fabricated in the same manner and following the same procedures as set forth in Example 2 except that the photoconductor used was tetraphenylhexapentaene, a cumulene type organic photoconductor.

Development of the resulting charge pattern on the imaging medium 72 produces a reproduction having a density of 1.5 – 1.7 density units in the dark areas but also produces some slight bakground.

EXAMPLE 7

The imaging procedure of this example follows the details and description set forth in Example 3 with the exception that the photoconductive layer of the modulator was prepared using 5 grams of poly(N-vinyl-7-H-benzo[c]carbazole) in 65 grams of chlorobenzene. The thickness of the layer after drying was about 5 microns.

The imaging process required about one second exposure to the emission electrode. The image density which resulted measured 1.5 units using a conventional densitometer.

EXAMPLE 8

The imaging techniques of this example followed the procedures set forth in Example 4 with the exception that the photoconductive layer of the modulator was prepared by dissolving 10 grams of poly(7-vinyl-iodo-7H-benzo[c]carbozole) in a solvent mixture comprising 70 grams of tetrahydrofuran and 110 grams of methylene chloride to which was added 5.6 grams of 2-(p-t-butylphenyl)-4-2(2,4,7-trinitrofluorenylidene)-2-oxazolin-5-one.

The ion projection process required about 1.3 seconds, and the density of the resulting copy was about 1.5 with a measurable background density of 0.02 density unit.

In the previous examples, as well as the general description, the CDS was described as being produced by the process shown in FIG. 1. It is intended that the CDS can also be produced in accordance with the described procedure hereinabove wherein the modulator is first applied a pattern of light and shadow followed by the AC corona. The final step is a blanket light exposure. This procedure results in producing a charge pattern where the light-struck areas correspond to the graphic portions of the original.

Referring now to FIGS. 6 and 7, there is shown an apparatus identified with the reference numeral 90 capable of carrying out the features and improvements of this invention utilizing the modulator described herein to produce high quality images from various types of originals on a suitable dielectric paper. The various operating instrumentalities that comprise the apparatus of this invention are mounted on a common base 92 to provide an in-line processing path.

At one end of the base 92 there is mounted an optical system 94 for projecting a pattern of light and shadow of a graphic original onto a modulator the construction of which was described hereinabove. Positioned along the base 92 along a rectilinear path that is coincident with the optical path of the optical system 94 are a series of frame members 96, 98, and 99, having disposed therein a corona charging electrode assembly 102, the modulator 104, and the corona emission electrode 106, respectively.

Located between the frame member 96 and the optical system 94 is a flash exposure arrangement comprising a high-intensity electromagnetic radiation source 108 an a reflector 110. The reflector 110 is positioned on the base 92 in such a manner that the impinging radiation from the source 108 is reflected directly into the optical path of the modulator 104 within the frame member 98. The optical system 94 is comprised of an original image holder 112 which is located between a pair of illumination sources 114 (FIG. 7) and a lens system 116 so that a projected pattern of light and shadow may be directed against the modulator 104. The lens assembly 116 is mounted in the front portion of a camera bellows 118 so that the optical distances may be adjusted to properly focus the projected pattern onto the modulator.

As shown in FIG. 7, the corona charging electrode assembly 102 is arranged to apply a blanket electrostatic charge to the insulating surface of the modulator 104. Within the frame member 96 there is mounted a pair of helical drive screws 120 and 122 (FIG. 6) and a pair of guide rods 124 and 126 which are located along the inside edge of the frame, being on either side of the optical path so as to provide vertical reciprocating movement for the corona wire elements 128 (FIG. 7) which are stretched in a horizontal direction within a frame 130 supported in position proximate to the modulator 104 by means of bracket members 132.

Figure 7A:
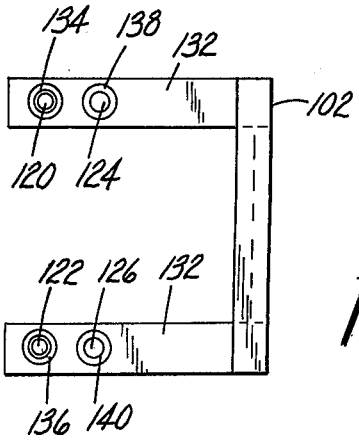

As shown in FIG. 7A, each of the bracket members 132 is equipped with bearing members 134, 136, 138 and 140 into which are received the helical drive screws 120 and 122 and the guide rods 124 and 126. The bearing elements have suitable mating elements for engaging the helical drive screws and the guide rods respectively so that the corona charging electrode assembly 102 is moved uniformly and steadily in a plane parallel and proximate to the insulating layer of the modulator 104. The distance between the corona wires and the surface of the modulator can be in the range of 0.5 centimeter to about 2 centimeters and preferably is in the range of about 0.8 to 1.1 centimeters.

Referring again to FIG. 7, a drive mechanism 142 is mounted on the base for driving the corona charging electrode assembly 102 along its vertical path immediately adjacent the modulator 104 to apply a uniform blanket electrostatic charge. Within the frame member 96 there are positioned microswitches or other suitable sensing devices (not shown) which mark the terminal positions along the vertical path taken by the brackets 132 as they move on the drive screws 120 and 122. As the brackets move to their uppermost limit, a microswitch is actuated reversing the drive mechanism 142, causing the brackets to now be moved downward to the lower-most limiting position where another microswitch is engaged, again reversing the drive. Hence, the reciprocating motion is continued for as many cycles as are required to impart a uniform charge onto the modulator 104.

As shown in FIGS. 7, 8, and 9, the frame member 98 houses the modulator 104 mounted on the metal frame 144. The modulator is secured to the metal frame by means of a suitable adhesive such as epoxy resin.

Included in the construction of the frame member is a collecting electrode 150 having operatively associated therewith a source supply of the dielectric material 152. The dielectric material referred to herein ultimately becomes the reproduction which contains the visual image of the graphic subject matter to be reproduced. A supply of the material 152 is made available from a roll 154 which is rotatably supported on brackets 156 affixed to the collecting electrode. During the imaging operation, a length of the material 152 is unwound from the roll 154 and displayed on the surface of the collecting electrode 150 (FIG. 9) in position to receive the ions which are projected through the modulator 104 and attracted towards the collecting electrode 150. The paper is held against the collecting electrode 150 by means of a differential pressure created between the back of the paper and the plate. The atmosphere from within the hollowed chamber 151 that comprises the collecting electrode is exhausted through the outlet 153 which is connected to a vacuum pump. The front face of the collecting electrode is provided with a set of narrow longitudinal slots 157 through which air is taken in causing the pressure differential.

The collecting electrode 150 is slidably received in track elements 158 (FIG. 9) located along lateral edges of the frame member 98 so that it can be raised into an inoperative position as shown in FIG. 7 during the time when a CDS is imparted to the modulator and lowered into position during the imaging cycle when the charged particles are emitted from the corona emission electrode 160, as shown in FIG. 8 of the drawings. Affixed to the frame 98 (FIG. 9) is a cutting mechanism 169 adapted to sever a length of the imaging material 152 by drawing the material between the jaws formed between an anvil 173 and a pivotable blade 174.

The electrode 160 is formed of a frame 162 which is made up of insulating material across which is horizontally stretched a series of fine wires 164. The frame 162 is adapted to reciprocate in a vertical path by means of the vertically disposed drive screws 166 and 168 which are disposed within the frame 99 at the lateral edges of the frame on either side of the optical path. The mounting of the corona emission electrode within the main frame 99 is similar in construction to the mounting and operation of the charging electrode within frame member 96. The corona emission assembly 160 is equipped with brackets 170 which are equipped with suitable bearing members (not shown) which matingly engage the drive screws 166 and 168. On the base of the apparatus, immediately adjacent to the frame 99, is a drive system 172 for reciprocating the electrode past the modulator during the imaging operation.

Referring now to FIG. 10, there is shown a schematic circuit diagram 180 for controlling the operation of the apparatus described in FIGS. 6, 7, 8 and 9.

The optical system is represented by the illumination source 114 (FIG. 7) and the graphic subject matter to be reproduced is shown as the arrow located between the illumination source and the lens 116. The illumination source 114 is connected across the power supply lines 182 and 184 by means of conductors 186 and 188, and is controlled between an operative and inoperative condition by the switch S-1. In order to flash expose the modulator 104, there is provided the flash lamp 108 which is connected to the supply lines by means of the conductors 188 and 190. This additional illuminating source is controlled by the switch S-2.

The modulator 104 is connected to ground and is positioned in the ion projection assembly between the corona emission assembly 160 and the collecting electrode 150. The corona wires 164 of the corona emission electrode assembly 160 are connected to a high-voltage source 192 through switch S-3 which is operable between the terminal 194, the negative terminal, or 196, the positive terminal of the high-voltage source. The plate electrode of the collecting electrode 150 is connected by means of the conductor 198 to the high-voltage source 200, operating through the switch S-4 which controls the connection of the electrode to either the negative terminal 202 or the positive terminal 204 of the high-voltage source.

With the collecting electrode assembly 150 in the raised position the modulator 104 is directly exposed to the corona wires 128 of the corona charging electrode assembly 102. The corona wires 128 are connected by means of the conductor 206 to the DC high-voltage supply 208 and an AC power supply 210 through the operation of the switch S-5 which can be operated to terminal 212, completing the conductive path to the DC source 208 or through terminal 214, which connects the AC supply 210 to the corona emission assembly. The high-voltage source 208 can selectively supply a negative voltage or a positive voltage through switch S-6 which is capable of selecting the negative terminal 216 or the positive terminal 218.

In the production of a copy on the imaging material 152 the power to all of the power supplies in the circuit is energized through the conductors 182 and 184. The collecting electrode 150 is moved to its inoperative position from between the modulator 104 and the corona wires 128. Switch S-5 is operated with a terminal 212, and switch S-6 is operated to the positive terminal of the high voltage DC source 208, resulting in the emission of positive gas ions from the electrode 128 which are then deposited on the insulating surface of the modulator 104. Such spraying of gas ions continues for several seconds until the charge level on the surface of the insulating layer is in the range of 250 volts. Concurrent with the spraying of charges from the electrodes 128 the illuminating source 108 is energized by closing the switch S-2 so as to illuminate the modulator, creating the proper conditions of resistivity in the photoconductive layer so that it has the proper rectifying properties.

At the conclusion of the charging cycle, switch S-2 is opened, and switch S-1 is closed, supplying a potential to the lamp 114. The lamp 114 directs electromagnetic radiation against the graphic original to be reproduced. Simultaneously with the energization of the lamp 114, switch S-5 is operated to its terminal 214 to provide a source of AC supply to the corona wires 128. It will be observed that any pattern of light and shadow produced by the projection assembly, passes through the corona wires 128, so that the insulating surface of the modulator 104 simultaneously experiences irradiations as well as the spraying of charges from the corona wires 128. At the conclusion of the simultaneous projection and AC corona projection step the collecting electrode assembly 150 is lowered into position between the corona charging electrode assembly 102 and the modulator 104. With the collecting electrode in position, the source of vacuum connected to the outlet 153 (FIG. 9) is activated so as to hold the imaging material 152 in position against the collection electrode during the ion projection step. To create a developable pattern on the imaging material 152, the high voltage source 192 is energized and through the operation of switch S-3 to the terminal 194, a high DC voltage is applied to the corona wire 164 so as to emit negatively poled gas ions. The projection of the negative ions proceeds for about one second in which time a charge pattern developable into a visual image corresponding to the graphic subject matter has been created on the imaging material 152.

What we claim is:

1. The method of making a developable image from a graphic original by creating a charge pattern on a dielectric medium through the use of a modulator adapted to selectively transmit charged particles in the presence of an electric field comprising the steps of:

1. creating a charge distribution system on said modulator wherein said modulator comprises a transparent insulating layer overlying a photoconductive medium deposited on a conductive screen by carrying out the steps of:

a. simultaneously applying a blanket electrostatic charge and exposing the insulating layer to electromagnetic radiation;

b. projecting a pattern of light and shadow on the surface of the insulating layer of the modulator simultaneous with the application of AC corona charge; and c. illuminating the insulating layer overall with electromagnetic radiation, and which charge distribution system persists on the modulator in the presence of radiation in the visible portion of the spectrum;

2. directing charged particles of one polarity against the conductive screen while said screen is connected to a reference potential;

3. positioning an electrode on the side of the modulator opposite the side against which the charged particles are directed, said electrode being connected to a high voltage source which is opposite in polarity to said charged particles;

4. removably affixing said dielectric medium to said electrode whereby said charged particles are selectively transmitted through certain portions of said modulator to produce a developable image on said dielectric medium.

2. The method of producing a developable image from a single graphic original having dark and light portions thereon by depositing a charge pattern on a receiving element for collecting charged particles thereon through the use of modulator means, said modulator means being adapted to selectively transmit charged particles therethrough, comprising the steps of:

1. creating a charge distribution system on said modulator wherein said modulator comprises a transparent insulating layer overlying a photoconductive medium deposited on a conductive foraminated structure and which charge distribution resides on the surface of the insulating top layer to produce a first electrical field across the insulating layer of said modulator, said first electrical field being a dipole charge across the insulating layer occurring in certain zones of said modulator corresponding to portions of said graphic original;

2. establishing a second electrical field in the vicinity of the conductive screen for projecting charged particles in the direction of said modulator;

3. establishing a third electrical field in the vicinity of said insulating layer for controlling the charged particles that are transmitted through said modulator toward said receiving element.

3. The method as claimed in claim 2 wherein said charge distribution system is of a polarity that is opposite to the polarity of said second field.

4. The method as claimed in claim 2 wherein said charge distribution system is of a polarity that is the same as the polarity of said second field.

5. The method as claimed in claim 2 wherein the second field is in the range of 400–800 volts/centimeter and the third field is in the range of 500 – 12,000 volts/-centimeter.

6. The method as claimed in claim 2 wherein said second field is created by a corona emission electrode positioned a distance in the range of from 1 to 4 centimeters from said base layer.

7. The method as claimed in claim 2 wherein said third field is created by positioning a plate electrode a distance in the range of from 0.5 to 1.5 centimeters from the insulating surface layer.

8. The method as claimed in claim 2 wherein said first field on said modulator corresponds to the dark portions of said original.

9. The method as claimed in claim 2 wherein said first field on said modulator corresponds to the light portions of said original.

10. The method as claimed in claim 8 wherein the second field is of a greater intensity than said third field.

11. The method as claimed in claim 9 wherein the second field is of lesser intensity than said third field.

12. The method of producing a developable image from a graphic original by depositing a charge pattern on a dielectric medium through the use of modulator means adapted to selectively transmit charged particles in the presence of a directing field comprising the steps of:

1. creating a charge distribution system on said modulator wherein said modulator comprises a photoconductive medium deposited on and partially enveloping a conductive screen, an insulating layer completely covering said photoconductive medium and conductive screen, comprising the steps of:

a. applying a blanket electrostatic charge to the insulating layer while the photoconductive layer is in a conducting state;

b. exposing the charged modulator to a pattern of light and shadow simultaneous with teh application of a charge erasing field;

c. illuminating the modulator uniformly;

2. directing charged particles of one polarity against the conductive screen while said conductive screen is connected to a reference potential;

3. positioning an electrode on the side of the modulator opposite the side against which the charged particles are directed, said electrode being connected to a high voltage source which is opposite in polarity to that of the charged particles;

4. removably affixing said dielectric receiving medium to said electrode whereby said charged particles are selectively transmitted through certain portions of said modulator to produce a developable image on said dielectric medium.

13. The method as claimed in claim 12 wherein the photoconductive meidum is selenium.

14. The method as claimed in claim 12 wherein the photoconductive medium is zinc oxide.

15. The method as claimed in claim 12 wherein the photoconductive medium is cadmium sulfide.

16. An ion modulator of the type described herein for use in an image reproduction system in which a developable charge pattern is produced on a charge receiving medium comprising a firmly bonded, multilayered structure in which the base layer is a conductive apertured or screen-like form, having top, bottom and side wall surfaces, an intermediate layer formed of light-sensitive photoconductive materials applied to the top surface of said base layer and partially enveloping the side wall surfaces, a top transparent layer of insulating material applied over the intermediate layer, said top layer enveloping the intermediate layer and the remainder of the side and bottom wall surfaces of the base.

17. The modulator structure as claimed in claim 16 in which the photoconductive material is selenium.

18. The modulator structure as claimed in claim 16 in which the photoconductive material is zinc oxide.

19. The modulator structure as claimed in claim 16 in which the photoconductive material is cadmium sulfide.

20. The method of making a developable image from a graphic original by creating a charge pattern on a dielectric medium through the use of a modulator adapted to selectively transmit charged particles in the presence of an electric field comprising the steps of:

1. creating a charge distribution system on said modulator wherein said modulator comprises a transparent insulating layer overlying a photoconductive medium deposited on a conductive screen by carrying out the steps of:
   a. applying a blanket elecrostatic charge to the insulating layer;
   b. projecting a pattern of light and shadow to the insulating layer;
   c. applying an AC corona charge to the insulating layer;
   d. illuminating the insulating layer overall with electromagnetic radiation, and which charge distribution system persists on the modulator in the presence of radiation in the visible portion of the spectrum;
2. directing charged particles of one polarity against the conductive screen while said screen is connected to a reference potential;
3. positioning an electrode on the side of the modulator opposite the side against which the charged particles are directed, said electrode being connected to a high voltage source which is opposite in polarity to said charged particles;
4. removably affixing said dielectric medium to said electrode whereby said charged particles are selectively transmitted through certain portions of said modulator to produce a developable image on said dielectric medium.

21. The method as claimed in claim 12 wherein the photoconductive medium comprises an organic photoconductor.

22. The method as claimed in claim 12 wherein the photoconductive medium comprises an organic photoconductive selected from the group consisting of benzofluorenes, dibenzofluorenes, cumulenes, polyvinylcarbazoles, polyvinylarocarbazoles, and polyvinyliododbenzocarbazoles.

23. The method as claimed in claim 12 wherein the photoconductive medium comprises an organic photoconductor and a sensitizer therefor.

24. The method as claimed in claim 12 wherein the photoconductive medium comprises an organic photoconductor selected from the group consisting of benzofluorenes, dibenzofluorenes, cumulenes, polyvinylcarbazoles, polyvinylarocarbazoles and polyvinyliodobenzocarbazoles, and a sensitizer selected from the group consisting of dyes and $\pi$-acids.

25. The method as claimed in claim 12 wherein the photoconductive medium comprises an organic photoconductor selected from the group consisting of benzofluorenes, dibenzofluorenes, cumulenes, polyvinylcarbazoles, polyvinylarocarbazoles and polyvinyliodobenzocarbazoles and a sensitizer selected from the group consisting of oxazolone and butenolide derivatives of fluorenone, dicyanomethylene substituted fluorenes and bianthrones.

26. The modulator structure as claimed in claim 16 in which the photoconductive material comprises an organic photoconductor.

27. The modulator structure as claimed in claim 16 in which the photoconductive material comprises an organic photoconductor selected from the group consisting of benzofluorenes, dibenzofluorenes, cumulenes, polyvinylcarbazoles, polyvinylarocarbazoles, and polyvinyliodobenzocarbazoles.

28. The modulator structure as claimed in claim 16 in which the photoconductive material comprises an organic photoconductor and a sensitizer therefor.

29. The modulator structure as claimed in claim 16 in which the photoconductive material comprises an organic photoconductor selected from the group consisting of benzofluorenes, dibenzofluorenes, cumulenes, polyvinylcarbazoles, polyvinylarcarbazoles and polyvinyliodobenzocarbazoles, and a sensitizer selected from the group consisting of dyes and $\pi$-acids.

30. The modulator structure as claimed in claim 16 in which the photoconductive material comprises an organic photoconductor selected from the group consisting of benzofluorenes, dibenzolfuorenes, cumlenes, polyvinylcarbazoles, polyvinylarocarbazoles and polyvinyliodobenzocarbazoles and a sensitizer selected from the group consisting of oxazolone and butenolide derivatives of fluorenone, dicyanomethylene substituted fluorenes and bianthrones.

* * * * *

Notice of Adverse Decision in Interference

In Interference No. 100,392, involving Patent No. 3,986,871, J. D. Blades and J. E. Jackson, CHARGED PARTICLE MODULATOR DEVICE AND IMPROVED IMAGING METHODS FOR USE THEREOF, final judgment adverse to the patentees was rendered Sept. 6, 1986, as to claims 1–4, 7–10 and 20.

[*Official Gazette November 25, 1986.*]